US012491552B2

(12) United States Patent
DePierri

(10) Patent No.: US 12,491,552 B2
(45) Date of Patent: Dec. 9, 2025

(54) BENDER

(71) Applicant: Robert G. DePierri, Baton Rouge, LA (US)

(72) Inventor: Robert G. DePierri, Baton Rouge, LA (US)

( * ) Notice: Subject to any disclaimer, the term of this patent is extended or adjusted under 35 U.S.C. 154(b) by 330 days.

(21) Appl. No.: 18/469,758

(22) Filed: Sep. 19, 2023

(65) Prior Publication Data

US 2024/0165687 A1 May 23, 2024

Related U.S. Application Data

(63) Continuation-in-part of application No. 18/057,214, filed on Nov. 20, 2022, now Pat. No. 11,794,233.

(51) Int. Cl.
*B21D 9/05* (2006.01)
*B21D 9/04* (2006.01)

(52) U.S. Cl.
CPC ..... *B21D 9/055* (2013.01); *B21D 9/04* (2013.01)

(58) Field of Classification Search
CPC . B21D 7/02; B21D 7/024; B21D 7/06; B21D 7/08; B21D 7/14; B21D 9/04; B21D 9/08; B21D 9/055; B21D 9/12
See application file for complete search history.

(56) References Cited

U.S. PATENT DOCUMENTS

| | | | | |
|---|---|---|---|---|
| 3,433,042 | A * | 3/1969 | Crihfield | B21D 7/024 72/422 |
| 4,485,664 | A * | 12/1984 | Richards | B21D 7/06 72/389.8 |
| 6,834,527 | B2 | 12/2004 | Hopwood | |
| 8,713,984 | B2 | 5/2014 | Wilson | |
| 2005/0056071 | A1 * | 3/2005 | Cappello | B21D 7/12 72/306 |
| 2009/0193864 | A1 | 8/2009 | Bulle | |
| 2017/0216900 | A1 * | 8/2017 | Koechig | B21D 7/024 |

OTHER PUBLICATIONS

Hand Tube Bender, 3/8 in. Tube OD, 15/16 in. Bend Radius, https://products.swagelok.com/en/c/hand-tube-bender/p/MS-HTB-6T captured Oct. 26, 2022.

Declaration Regarding Prototype Testing of Tubing Bender, Tom Hamner & Tom DePierri Jan. 27, 2023, Robert DePierri Jan. 28, 2023.

* cited by examiner

*Primary Examiner* — Teresa M Ekiert
(74) *Attorney, Agent, or Firm* — Edel Patents LLC; John B. Edel

(57) ABSTRACT

Benders are disclosed relating to the convenient, accurate, and precise bending of tubing. Example benders include features such as a mandrel, adjustable mechanical stops, and scales having relatively high resolution along with significant distance from a central axis of the mandrel. Certain benders may include separate fine and coarse adjustments to bend angles and support mechanisms for controlling the bend plane angle.

20 Claims, 16 Drawing Sheets

BENDER

Benders disclosed herein may be used in the convenient, accurate, and precise bending of tubing. Benders disclosed herein include a variety of features that allow for bending operations that enhance many bend characteristics including the accuracy and precision of bend angles, bend plane angles, and bend positioning along the tubing.

DETAILED DESCRIPTION

Figure 1:
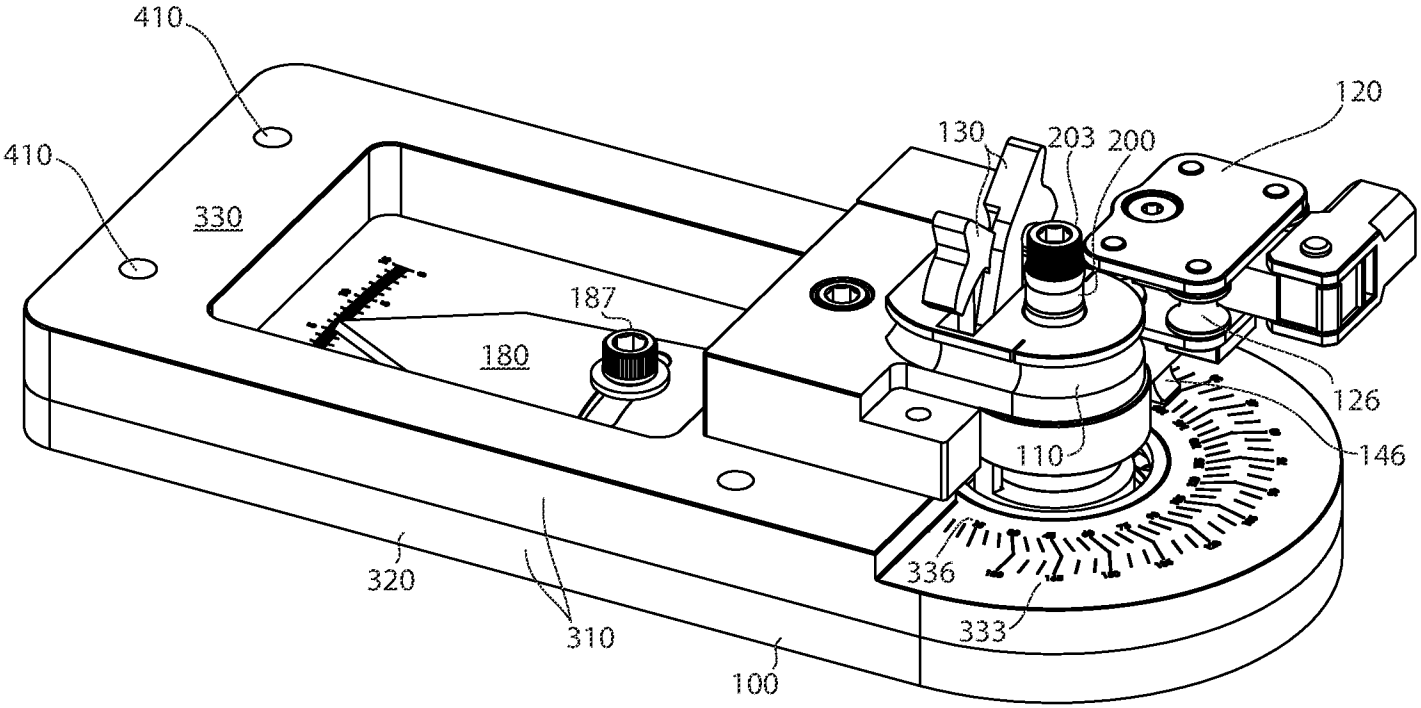
FIG. 1 is a perspective view of components of the bender.
Figure 2:
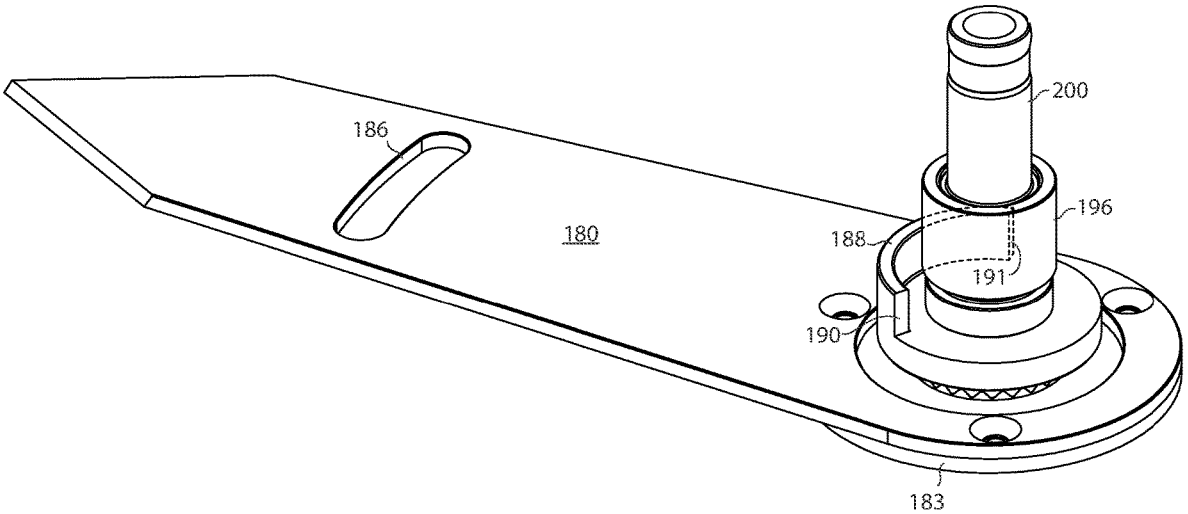
FIG. 2 is a perspective view of components of the bender.
Figure 3:
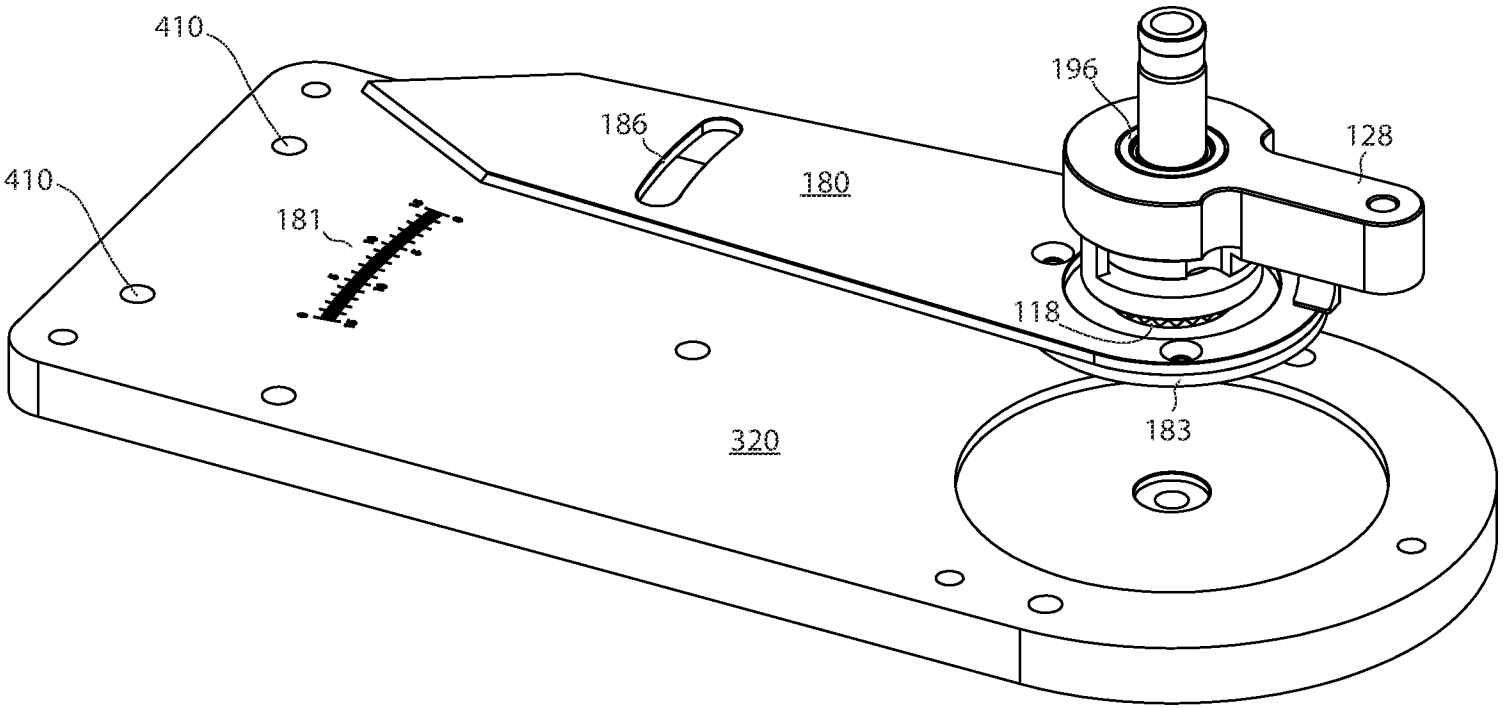
FIG. 3 is an exploded perspective view of components of the bender.
Figure 4:
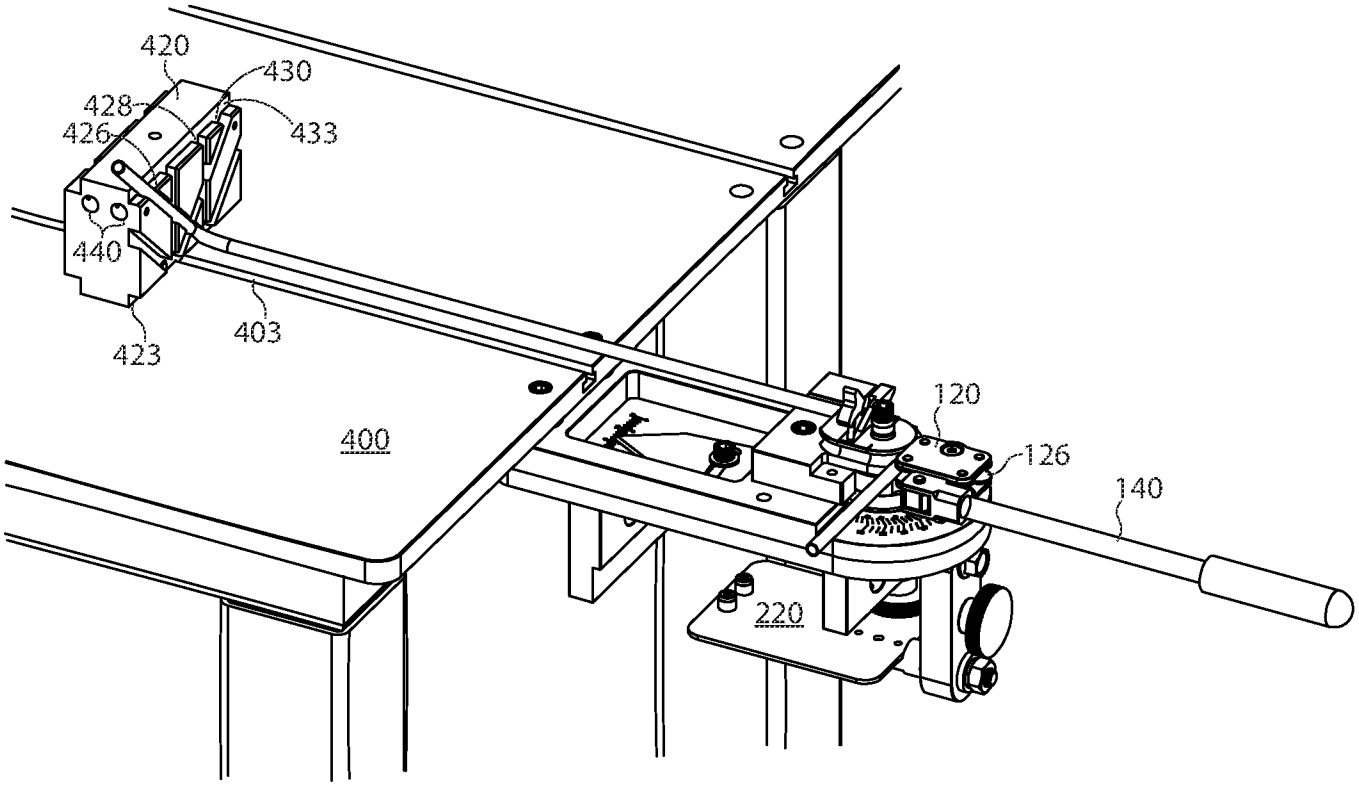
FIG. 4 is a perspective view of a bender including a backstop on a table.

FIGS. 1-7 depict a first embodiment of bender 100 and FIGS. 8-16 depict a second embodiment of bender 100. As depicted in the figures, bender 100 may include:

mandrel 110,
bend angle Hirth joint 118,
roller carriage 120,
rollers 126,
bender link arm 128,
catches 130,
lever handle 140,
counterclockwise bend coarse indicator 146,
bend angle fine adjustment arm 180,
bend angle fine adjustment scale 181,
bend angle arm Hirth joint plate 183,
fine angle lock bolt slot 186,
fine angle lock bolt 187,
stop ring 188,
clockwise stop ring mechanical stop 190,
counterclockwise stop ring mechanical stop 191,
needle bearing 196,
annular post 200,
Hirth joint lock bolt 203,
extension shaft 210, bend plane angle plate 220,
bend plane plate support arm 226,
bend plane Hirth joint 250,
housing 310,
housing lower plate 320,
housing upper plate 330,
clockwise coarse bend scale 333,
counterclockwise coarse bend scale 336,
housing cover 348,
extension shaft support bushing 370,
vice lug—extension shaft support bushing 380,
table 400,
table T-slot 403,
table attachment bolt holes 410,
table attachment bolts 413,
block backstop 420,
0° slot 423,
45° slot 426,
90° slot 428,
135° slot 430,
distal non-90°-angle bend slot 433,
support bar openings 440,
support bar 443,
support bar tabs 446,
tabletop T-track 500,
tabletop T-slot 503,
tabletop T-track bolts 506,
pin holes 510,
pin secured tube support disk 520,
T-slot boltable tube support disk 526,
knob handle bolt 527
partially conical backstop 530,
half-cylinder backstop 536,
offset backstop bolt holes 538,
30° slot 540,
multifunction backstop 600,
magnet 610,
keyway 613,
magnetically secured key 620,
T-slot nut 626,
straight tubing stop 630,
15° tubing slot 631,
45° tubing slot 633,
75° tubing slot 636,
105° tubing slot 638,
135° tubing slot 640,
165° tubing slot 641,
fingers 642,
0° tubing slot 643,
30° tubing slot 644,
60° tubing slot 645,
90° tubing slot 646,
120° tubing slot 647,
150° tubing slot 648,
180° tubing slot 649,
primary T-slot track 650,
linear scale 651,
mounting clips 653,
spherical washer 656,
T-slot track extension piece 670,
conical point set screw 683,
tube marking aid 690,
bender tongue receiver 700,
bender tongue 710,
bend angle mechanical stop position scale 730,
bend angle mechanical stop position indicator 733,
longitudinal linear bearings 760, longitudinal linear bearing housing 763,
longitudinal linear bearing housing upper frame 764,
longitudinal linear bearing locking and handle bolt 765,
transverse linear bearings 770,
transverse linear bearing shafts 771,
bend plane angle plate Hirth joint 780,
bend plane angle plate deployment Hirth joint 783,
eccentrically adjustable fine bend angle mechanical stop 790,
bend plane angle plate A-side 803,
bend plane angle plate B-side 806,
bend plane angle plate B-side recess 807,
bend plane angle plate mounting bracket 810,
bend plane angle plate mounting bracket A-side 813,
bend plane angle plate mounting bracket B-side 816,
bend plane plate tubing support disks 820, and
two-way tube latch 830.

As that term is used herein "tubing" includes hollow generally cylindrical structures having an outer diameter less than 0.7 inches capable of conveying fluids over a distance.

As that phrase is used herein "bend radius" designates a property of the bender including the mandrel. Typically, a bender-mandrel combination has a specified tubing outside diameter and bend radius for which the bender-mandrel combination is designed to work. In that case, the bend radius designates the nominal bend radius for the bender-mandrel combination. Absent a nominal bend radius, the bend radius designates the bend radius created by bending the largest tubing that fits in the mandrel. Bend radius is also used herein as a unit of measure. For example, 1.5 bend radii designates 1.5 times the bend radius.

As that phrase is used herein "bend plane" indicates the plane in which a section of a bent piece of tubing or other similar material lies. When a piece of tubing is in a bender, the bend plane designates the plane in which bending is to occur.

As that phrase is used herein "active bend" designates the bend to be made by the bender or being made by the bender.

As that phrase is used herein "distal bend" designates a bend separated from the active bend by a section of tubing that is generally straight.

As that phrase is used herein "active bend plane" designates the plane in which bending by the bender occurs.

As that phrase is used herein "distal bend plane" designates the bend plane of a distal bend on the same piece of tubing that is separated from the active bend plane by a length of tubing that is generally straight.

As that phrase is used herein "bend plane angle" indicates the degree to which a distal bend plane is rotated out of alignment with the active bend plane. The axis from which bend plane angle is judged is the axis of the tubing between the active bend and the distal bend. The bend plane angle, as used herein, is directional and is measured by looking down the tubing from the active bend to the distal bend to judge the degree of clockwise separation of the distal bend from the active bend. Thus, two 90° bends having a bend plane angle of 0° would create a shape resembling a "U." Similarly two 90° bends having a bend plane angle of 180° would create a shape resembling a zigzag. Although the two described bend pairs occur in the same plane, they have distinct bend plane angles.

As that phrase is used herein "stationary side" designates the side of the tubing that remains stationary during bending. In the case of rotary draw benders, "stationary side" represents the side of the tubing that remains largely stationary in that it undergoes modest translational movement during bending as opposed to a sweeping rotational movement.

As that phrase is used herein "free side" designates the side of the tubing that undergoes substantial movement during the bending process. In the case of rotary draw benders, it is the side undergoing a sweeping rotational movement.

As that phrase is used herein "bend plane angle support" is a support that holds some portion of a distal bend in place either at the initiation of bending by the bender or during bending by the bender.

As that phrase is used herein a "multiple bend plane angle support" is a bend plane angle support that may be used to support multiple bend plane angles.

As that phrase is used herein a "rotating bend plane angle support" is a bend plane angle support that may be rotated to support multiple bend plane angles.

As that phrase is used herein a "infinite rotating bend plane angle support" is a bend plane angle support that may be rotated to support an infinite number of bend plane angles.

As that phrase is used herein "bend plane angle double support" is a bend plane angle support having multiple surfaces that act collectively to restrain tubing from rotating in either direction.

As that phrase is used herein "incremental angle lock" designates the various types of mechanical devices capable of locking one component to another component in multiple precise, repeatable angular relationships to one another based on pre-determined angle spacing. Examples include Hirth joints, various types of pin locks, and precision machined pairs of components meeting that criterion. Infinitely adjustable angle locks would not be incremental angle locks as that phrase is used herein.

As that phrase is used herein "mechanical stop" is limited to components that physically limit the bending range of motion thereby preventing both damage and overbending of the tubing. U.S. Pat. No. 6,834,527 to Hopwood discloses a bender with an "adjustable mechanical stop." However, the type of stop described would not be considered a mechanical stop as that phrase is used herein because it allows for bending beyond the stop and because it allows for tubing damage from overbending. Either characteristic would disqualify a stop from being a mechanical stop as that phrase is used herein. According to the present disclosure, the type of mechanical relationship described by the Hopwood patent is a potentially destructive bend angle indicator not a mechanical stop.

As that phrase is used herein "coarse adjustment angle indication" indicates a component or a group of components that may be used to identify the status of mechanical relationships that can vary the position of a mechanical stop controlling the bend angle by greater than 25°. An example of a coarse adjustment angle indication is the bend angle mechanical stop position indicator and bend angle mechanical stop position scale pair. Another example is the counterclockwise bend coarse indicator and counterclockwise coarse bend scale pair.

As that phrase is used herein "fine adjustment angle indication" indicates a component or a group of components that may be used to identify the status of mechanical relationships that can vary the position of a mechanical stop controlling the bend angle by no greater than 25°. An example of a fine adjustment angle indication is the bend angle fine adjustment arm and bend angle fine adjustment scale pair.

Tubing, conduit, and other similar materials may be bent with the bending apparatus described herein and the bending methods described herein. The invention may have particular utility when making precise bends and may have particular utility when used on nominal ½ inch diameter tubing and smaller tubing sizes. Features described herein may allow bend angles to be achieved with both accuracy and precision. Mechanical stops, repeatable settings, a stable work environment, and precise fine adjustments may each contribute to reliable and repeatable bending operations that may be difficult or impossible to achieve with traditional manually operated benders.

Oftentimes to make the desired bends, a conventional manual tubing bender with a fixed or rotatable mandrel about which the tubing is bent is employed, and these mandrels typically include a plurality of radially inscribed lines on the mandrel corresponding to the bend angle that personnel use to determine when the bend is complete. Personnel using conventional manual tubing benders may experience challenges including closely spaced angle markings on the mandrel that have large increments such as 15° increments. This may result in personnel estimating bend angles and inaccurately executing bend angles due to the scale resolution.

Certain embodiments described herein have a scale located at least 1.2 bend radii from the mandrel axis of symmetry, with some scales located at least 1.6 bend radii from the mandrel axis of symmetry, with a fraction of those scales located at least 2.5 bend radii from the mandrel axis of symmetry, and certain scales located at least 4.0 bend radii from the mandrel axis of symmetry.

Various backstops and bend angle supports described herein aid in achieving accurate and repeatable start-of-bend locations.

The bender described herein is a bi-directional bender which may more easily accommodate sufficient clearance to bend tubing of certain geometries with long tangents and multiple bends. The bender is also alignable with and attachable to tables allowing for large tubing support surfaces. Benders having a single bend direction are also contemplated and may have many combinations of the remaining features disclosed herein.

The bi-directional bending configurations described herein may have further operational benefits. When the angle between the active bend plane and the distal bend plane is greater than 180°, but less than zero degrees, bending the active bend in the counterclockwise direction enables the user to potentially use the backstop to align the distal bend plane provided that the backstop is designed for the bend angle of the distal bend and the backstop includes a groove machined at an angle that corresponds to the desired bend plane angle. This may have extra utility beyond what is achievable with the bend plane plate when the distance between the distal bend and the active bend exceeds that which the bend plane plate can accommodate. The length of tubing the bend plane plate can accommodate is limited by the length of the extension shaft and the effects of long cantilevers on the extension shaft. Furthermore, even if the extension shaft is long enough to accommodate a distal bend, if the tangent on the free side of the active bend is relatively short, and the tangent on the stationary side of the active bend is relatively long, it will be much easier to manipulate the tubing into the proper position in the bender as well as execute the bend if the longer portion of the tubing is the stationary side rather than the free side.

The depicted bender may include a mandrel around which tubing may be bent. The mandrel may be fixed to the housing such that the mandrel does not rotate. The roller carriage may rotate around the mandrel pressing the tubing against the mandrel to bend the tubing. The mandrel may be a replaceable mandrel. Replaceable mandrels allow for the same bender to be reconfigured to bend different diameter tubing and reconfigured to bend the same diameter tubing to a different bend radius.

During the bending, catches may hold the stationary side of the tubing in place. The lever handle may act as a lever to urge the roller carriage around the mandrel for bending. In the depicted embodiment, the lever handle may be secured to the roller carriage in a variety of orientations to enable bending tubing in the clockwise direction as well as the counterclockwise direction without having to replace any of the bender's components.

The bend angle Hirth joint connects the stop ring to the bend angle fine adjustment arm. The bend angle Hirth joint may for example have 24 teeth allowing the stop ring to orient itself in increments of 15° relative to the bend angle fine adjustment arm. The bend angle Hirth joint may have a variety of tooth configurations including those that create increments of 10° and 5°. The annular post may be secured within the stop ring such that they operate as a single component. The Hirth joint lock bolt which runs through the annular post may fasten to the bend angle arm Hirth joint plate and when tightened the Hirth joint lock bolt locks the bend angle arm Hirth joint plate and the bend angle fine adjustment arm in place relative to the annular post and the stop ring mechanical stop. The stop ring may have two stop ring mechanical stops when the bender is configured for bending in both directions. In such cases, the operation of the counterclockwise stop ring mechanical stop is essentially the same as the clockwise stop ring mechanical stop. The bend angle arm Hirth joint plate is situated within a circular recess in the housing upper plate. Coarse adjustments may be locked in place using the bend angle Hirth joint which may be characterized as an incremental angle lock.

The bender link arm freely rotates around the annular post with the assistance of the needle bearing. In some embodiments a bushing or other suitable bearing may be used in place of the needle bearing. The bender link arm and the roller carriage begin at the initial 0° bend position because the housing limits further rotation of the roller carriage around the housing to help ensure correct starting position for the bend.

When the bend angle fine adjustment arm points at 0° on the bend angle fine adjustment scale, the relationship in the bend angle Hirth joint controls the maximum tubing bend allowed by the bender giving possible maximum bend angles of 15°, 30°, 45°, 60°, 75°. 90°, 105°, 120°, 135°, 150°, 165°, and 180° at which point the bender link arm contacts the stop ring mechanical stop completing the bend. Separate fine adjustment scales and coarse adjustment scales may be used based on the direction of bending. That is, different scales may be used for clockwise bending and counterclockwise bending. In each of those cases, repeatable bending may be accomplished by bending until reaching the mechanical stop. A precise replica of the bend angle may be repeated by inserting another piece of tubing and bending again to the mechanical stop.

Springback of tubing during the bending process and a desire to achieve angles between the increments allowed by the bend angle Hirth joint may both be accounted for by adjustment of the bend angle fine adjustment arm. Adjustment of the bend angle fine adjustment arm may be accomplished by loosening the fine angle lock bolt and moving the bend angle fine adjustment arm such that the bend angle fine adjustment arm points to the desired location bend angle fine adjustment scale and then locking the bend angle fine adjustment arm in place with the fine angle lock bolt. The fine angle lock bolt slot allows the bend angle fine adjustment arm to move freely relative to the housing upper plate and to lock securely to the housing upper plate in any desired position. The combination of incremental adjustments using the bend angle Hirth joint and by positioning the bend angle fine adjustment arm allows for the coarse and fine adjustment of the position of the stop ring mechanical stop at any angle within the range of motion of the bender. The position of the bend angle fine adjustment scale allows for manual adjustments of bend angle having a high degree of accuracy. The precisely repeatable positions into which the bend angle Hirth joint may lock prevents the loss of the benefit of the high accuracy adjustments on the bend angle fine adjustment scale by preventing the introduction of small coarse adjustment angle setting errors. The bend angle fine adjustment scale may be in 1° increments or in 0.5° increments.

The mandrel and various other components of the bender may be configured such that they allow for bending in both directions around the mandrel. In such cases the stop ring would have an additional stop ring mechanical stop on the opposite side of the stop ring. The operation of the additional stop ring mechanical stop would be similar and interact with the bender link arm in a similar way that creates a similar control of bend angle. Indication of bend angle by indicators such as the counterclockwise bend coarse indicator operate on the depicted clockwise coarse bend scale and the depicted counterclockwise coarse bend scale. When setting the coarse range of motion of the bender the range of motion may be confirmed by observing the range of motion on the indicators on these coarse scales. The utility of the bender may be enhanced by having a scale that has at least one marking for every 5° on the scale, with further enhanced utility in cases where the scale has at least one marking for every 1° on the scale, still further enhanced utility in cases where the scale has at least one marking for every 0.5° on the scale, and still further enhanced utility in cases where the scale has at least one marking for every 0.2° on the scale.

The extension shaft may be configured to be slidably held by the extension shaft support bushing and the vice lug—extension shaft support bushing to support the bend plane angle plate. The bend angle plate may be connected to the extension shaft by the bend plane plate support arm and the associated bend plane Hirth joint. The extension shaft support bushing and the vice lug—extension shaft support bushing may be attached to the housing lower plate so that the extension shaft support bushing and the vice lug—extension shaft support bushing may be used for connection to a table, vice, or other equipment. The bend plane Hirth joint may be configured with 24 teeth like the bend angle Hirth joint allowing easily setting of a range of typical bend plane angles. When setting up for bending, the tubing to be bent may rest on the bend plane angle plate with the bend plane angle plate configured such that the distal bend is supported at the desired bend plane angle. Once the appropriate bend plane angle is established, the bend plane angle plate may be removed or may remain in place depending on the degree to which it would interfere with the bend to be made.

The housing cover may be positioned to support the tubing during and before bending. The housing cover may also include a T-slot for aligning and securing the axial position of a backstop. The T-slot in the housing cover may align with a table T-slot such that the backstop may be positionable in a wide range of locations situated various distances from the start-of-bend location. The bender may be table mountable so that the tubing's stationary side rests flat on the table before bending. The backstop may be repositionable along a tubing axis of the stationary side of the tubing to be bent such that the backstop is in alignment with that axis. The variable position backstop allows for precise and measured control of the location of bends in the tubing. Backstops such as the block backstop and the half-cylinder backstop may contain a 0° slot for holding 90° distal bends at a bend plane angle of either 0° or 180°. Those backstops may contain a 45° slot for holding 90° distal bends at a bend plane angle of 45°. A 90° slot and a 135° slot may hold corresponding bend plane angles. The backstops may be configured to support a distal bend having a bend plane angle of −90°. Achieving a bend plane angle of −90° may be accomplished in a similar manner to creating a bend plane angle of 90°, but the tubing and bender would be set up for a counterclockwise bend rather than a clockwise bend. Other bend plane angles such as −45° would be accomplished using similar techniques. The block backstop may contain similar slots aligned with the other side of the mandrel so that equivalent restraint of bend plane angles may be accomplished during both clockwise and counterclockwise bending when the backstop is securely held in a T-slot. The distal non-90°-angle bend slot may be used to hold distal bends that are non-90° bends. However, the distal non-90°-angle bend slot is primarily useful when the bend plane angle is 0° or 180°. Support bar openings may be used to hold a support bar situated in one of support bar openings which may be used along with support bar tabs to further restrain the position of tubing held in the distal non-90°-angle bend slot. These bend slot configurations provide readily accessible multi surface support for the tubing to be bent. The backstop may be flipped to alternate between usage of the distal non-90°-angle bend slot and the other slots. In certain embodiments, the backstop may be configured to support bend plane angles of −135°, −90°, −45°, 0°, 45°, 90°, 135°, and 180°. A variety of similar backstops may be utilized including those having slots ranging from 0°-180° in 15° increments and backstops that accommodate distal bend angles that are other than 90° including backstops that would for example accommodate distal bend angles of 45° such as the partially conical backstop. The partially conical backstop accommodates 45° distal bend angles and has a generally conical form with slots in the outer surfaces of the generally conical form. The partially conical backstop is depicted as accommodating 45° distal bend angles, but a wide variety of alternate angles could be produced.

A tabletop T-track may be used with an existing table such that a tabletop T-slot within the tabletop T-track accommodates components to secure distal bends. The tabletop T-track may be secured to a table by Tabletop T-track bolts. Pin holes in the tabletop T-track may be arranged along the tabletop T-slot such that a pin secured tube support disk is positioned to abut the piece of tubing being bent. Similarly, a T-slot boltable tube support disk may be used to contact and stabilize the piece of tubing being bent. These support discs may take many forms including blocks, cylinders, etc. And may be configured to provide only horizontal support or they may be configured to have a lip, recess, or other feature restraining the tubing from vertical movement. Such support discs are useful in conjunction with backstops that accommodate distal bends less than 90°, such as the partially conical backstop, 530, because they can limit the tendency of such backstops to act as a wedge elevating the tubing off the supporting table.

Backstops such as the half-cylinder backstop and the partially conical backstop may be configured with offset backstop bolt holes allowing the slots on the backstops to align with tubing on either side of the T-slot that allows a both ends of a single backstop to be used for both clockwise and counterclockwise bends. These backstops may be configured with T-slot fasteners that fix the backstop in alignment with the T-slot on either side of the T-slot. This configuration allows the slots on this type of backstop to have a first set of slots on one side incremented for bend plane angles such as 30°, 60°, 90°, etc. And another set of slots on the other side incremented for bend plane angles such as 15°, 45°, 75°, etc. The selection of slot angles may be chosen based on common needs or specialty considerations.

Tubing benders described herein may include adjustable mechanical stops. Those stops may be configured such that the maximum bend angle may be set. The manner of setting may be such that a coarse adjustment may be set followed by a fine adjustment. When setting the bend angle, the user may add some number of degrees to the final desired tubing bend angle to account for springback of the tubing. Because the amount of springback is dependent on the bend angle as well as the strength of the material being bent, the setting of the bend angle may be determined by experimentation, tables, formulas, or other equivalent methods. The determination of the correct bend angle setting on the bender and the mechanical stops that allow reproduction of that precise bend angle allows for precise and accurate repetition of identical bends in the tubing or for production according to specifications.

The bend angle fine adjustment arm extends well beyond the bend radius of the mandrel, so the user is much better able to perceive small changes in the bend angle. For example, the bend angle fine adjustment arm may be long enough to allow users, without using optical magnification, to make adjustments on a scale incremented at 0.2°. The stops may be manually set relying on hand adjustment while observing the physical position of the bend angle fine adjustment arm. In the depicted embodiment, the bend angle Hirth joint may be engaged and disengaged to set coarse adjustments which may for example be in 15° increments. The bend angle Hirth joint may be locked and unlocked by rotating the Hirth joint lock bolt such that the bend angle Hirth joint may reoriented to the desired coarse adjustment angle then screwed in to lock in the desired coarse adjustment angle.

The way the bend angle fine adjustment arm and the bend angle Hirth joint combine to control adjustment of the mechanical stop allow for high accuracy bending from a device having limited dimensions.

The bend plane angle plate may be used to establish the target bend plane angle accurately and efficiently when the distal bend is located in front of the bender. The bend plane angle plate may be connected to the bender via a bend plane Hirth joint with 24 teeth to facilitate adjusting it to the more commonly used angles. Hirth joints with other numbers of teeth or connections that otherwise limit the number of angle options may also be used. Also, the connection may be one that does not limit the orientations to common angles. The bend plane Hirth joint may for example be configured such that it is capable of locking into place with an infinite number of orientations such as by including a washer between the teeth of the bend plane Hirth joint before locking the bend plane Hirth joint in place.

The backstop may be used to establish the start-of-bend location accurately and efficiently for each bend. The backstop may be adjusted by loosening a bolt that runs through the backstop into a threaded fastening plate in the T-slot, sliding the backstop to the new desired location, and retightening the bolt running through the backstop.

The bender may be capable of executing clockwise as well as counterclockwise bends. This capability may resolve users need for large clearance areas on all sides of the bender as may be needed with unidirectional benders.

Operation of the bender may proceed by loosening the Hirth joint lock bolt and lifting then rotating the annular post until the appropriate range of motion for the coarse adjustment is established then retightening the Hirth joint lock bolt. The fine angle lock bolt then may be loosened for adjustment of the position of the bend angle fine adjustment arm relative to the bend angle fine adjustment scale followed by tightening the fine angle lock bolt. The catch may be opened to slide tubing between the mandrel and the roller carriage positioning and securing the tubing optionally with the assistance of either the backstop or the bend plane angle plate. Once the tubing is properly positioned bending may occur by pulling the lever handle until the mechanical stop is reached.

The roller carriage may be configured symmetrically with four rollers such that the roller carriage can use two rollers for clockwise bending then reorient to use the opposite two rollers for counterclockwise bending. Doing so may be accomplished by simply rotating the lever handle and roller carriage into the starting bending position for the opposite direction bend and setting the new bend angle. This may be accomplished without replacing bender components. This process may optionally include reorienting the lever handle relative to the roller carriage for more ergonomic operation.

FIGS. 8-17 depict an embodiment sharing significant features with the embodiment depicted in FIGS. 1-7. Certain differences are described below.

The T-slot boltable tube support disk may be configured such that it is secured to the primary T-slot track by a knob handle bolt. The T-slot boltable tube support disk may be configured in other mechanically similar attachment means that allow for alternatingly removing and securing the T-slot boltable tube support disk to the primary T-slot track and the T-slot track extension piece.

Instead of a pair of catches, a two-way tube latch may be used to secure the tubing adjacent to the mandrel. In this context "catch" and "latch" are used synonymously.

The multifunction backstop is configured to accept and secure a wide variety of tubing configurations and orientations for operation of the bender.

The multifunction backstop may have a series of magnets arranged in a pair of keyways such that a magnetically secured key with an attached T-slot nut may be quickly and securely joined to the multifunction backstop. The pair of keyways allows for the multifunction backstop to be detached and repositioned such that the straight tubing stop aligns with the tubing to be bent as that tubing is aligned with the mandrel for bending regardless of the bend direction (i.e., clockwise or counterclockwise). Similarly, the pair of keyways allows for the multifunction backstop to be detached and rotated 180° along a vertical axis to expose different slots on the multifunction backstop to the tubing.

When the front of the multifunction backstop faces the mandrel each of the 15° tubing slot, the 45° tubing slot, the 75° tubing slot, 105° the tubing slot, the 135° tubing slot, and the 165° tubing slot also face the mandrel.

When the back of the multifunction backstop faces the mandrel each of the 0° tubing slot, the 30° tubing slot, the 60° tubing slot, the 90° tubing slot, the 120° tubing slot, the 150° tubing slot, and the 180° tubing slot also face the mandrel. The front and the rear of the multifunction backstop can align with either side of the mandrel such that within 15° increments the multifunction backstop can aid in achieving any desired bend plane angle.

The fingers of the multifunction backstop are such that each slot can handle a wide variety of distal angles for the bend plane angle that the slot accommodates. For example, the 75° tubing slot accommodates a bend plane angle of 75°. Because the fingers protrude from the multifunction backstop, the 75° tubing slot could hold tubing with a 30° bend angle, a 45° bend angle, a 60° bend angle, a 90° bend angle, or even some bend angles beyond 90°. Any number of bend angles can be accommodated by any of the tubing slots. However, low bend angles like 10° may result in only a small amount of tubing falling within the slot. Straight tubing may be secured in the straight tubing stop of the multifunction backstop.

Figure 8:
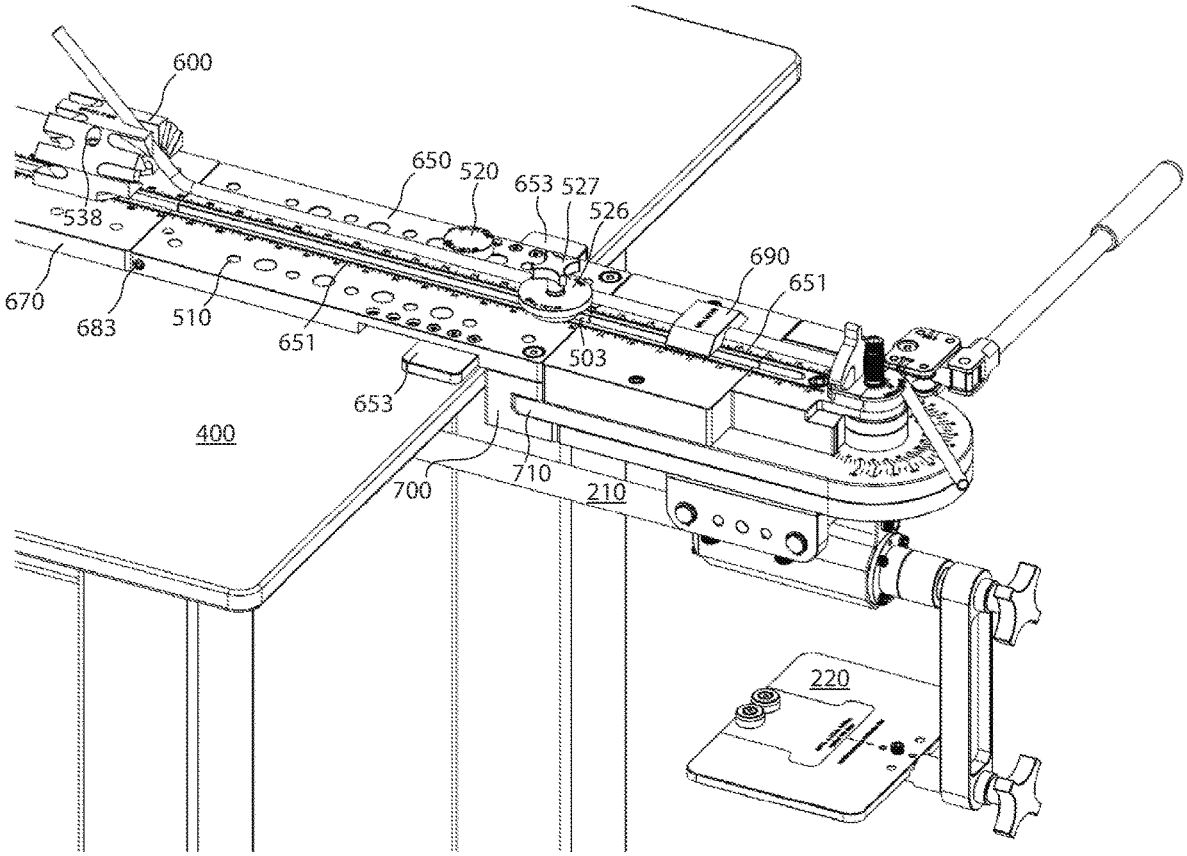
FIG. 8 is a perspective view of a bender mounted on a table.
Figure 9:
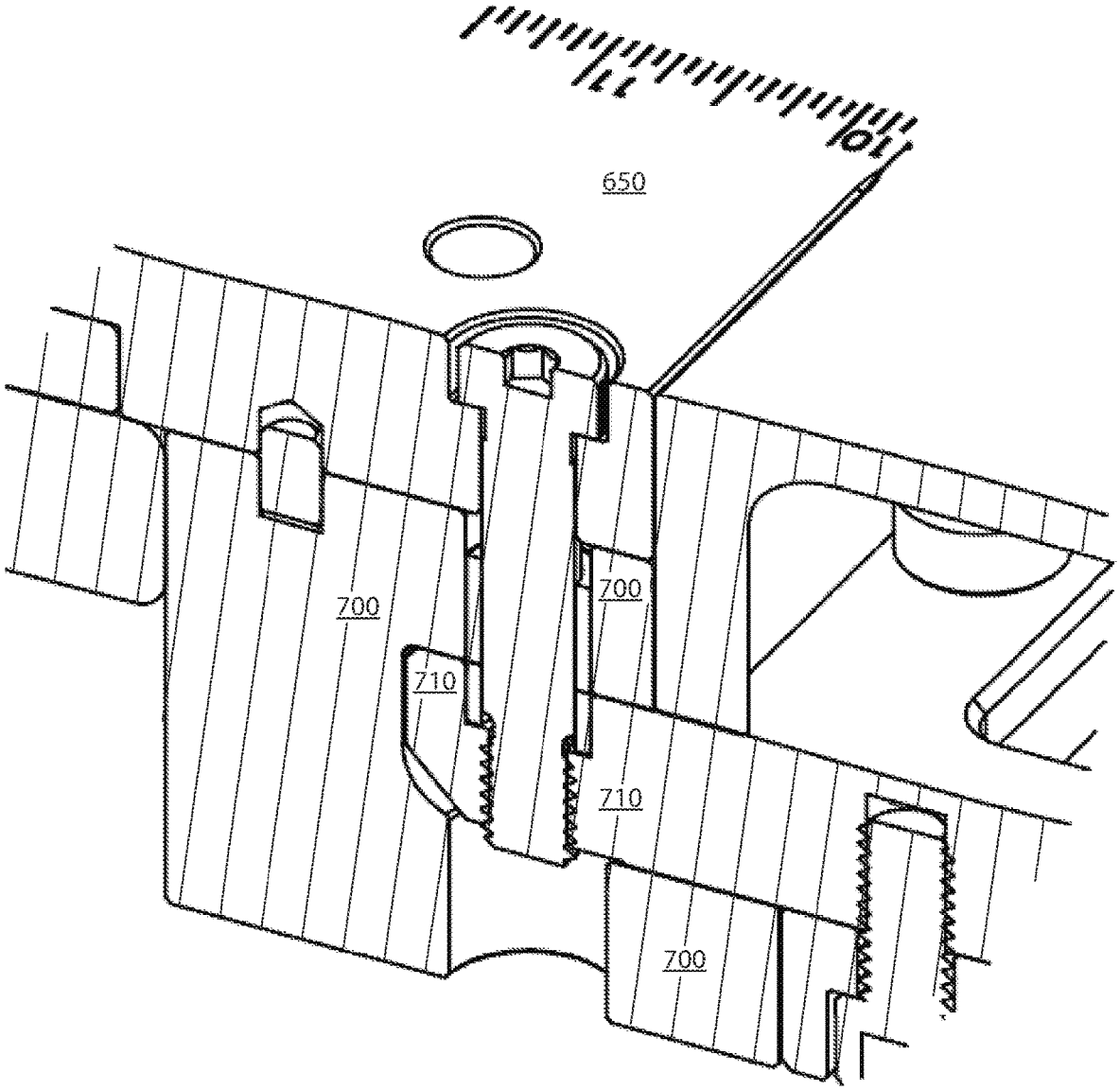
FIG. 9 is a close-up cutaway of the joining relationship between the bender tongue receiver and bender tongue.
Figure 10:
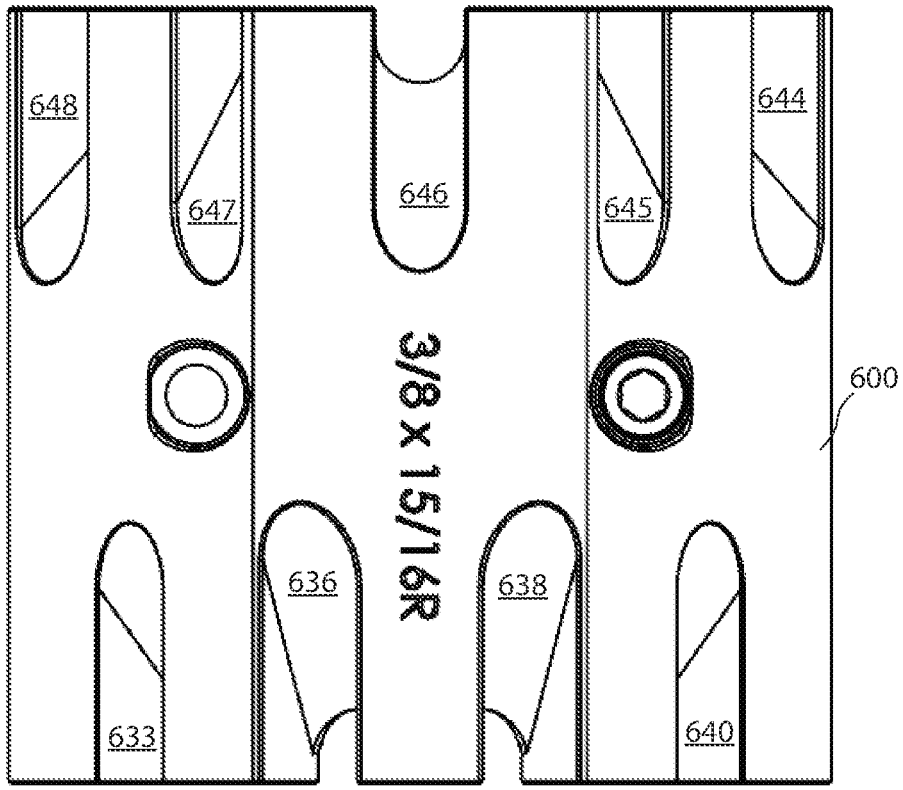
FIG. 10 is a plan view of the multifunction backstop.
Figure 11:
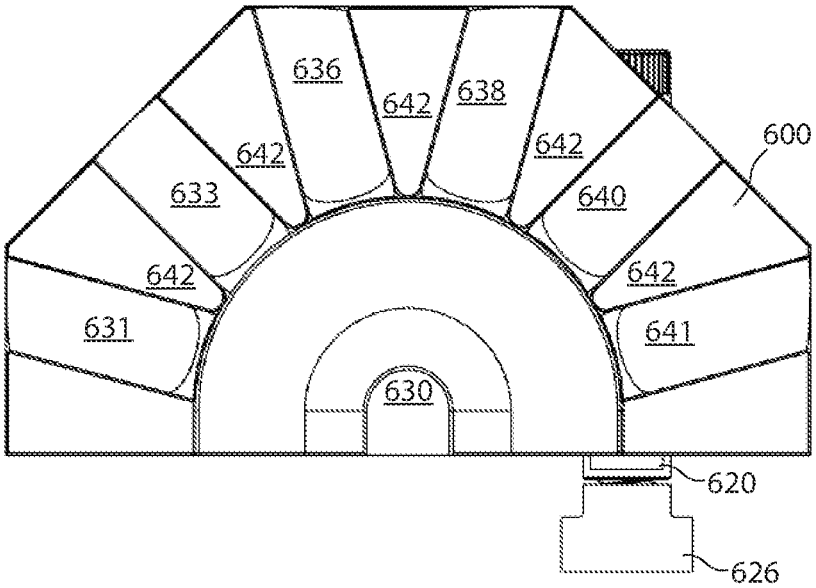
FIG. 11 is an elevation view of the multifunction backstop.
Figure 12:
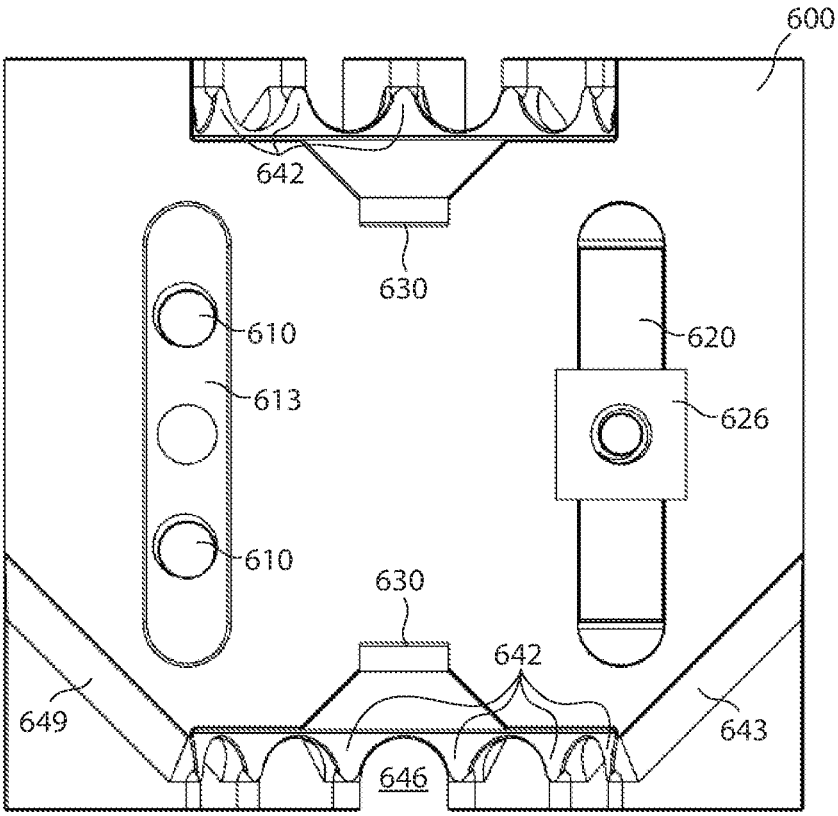
FIG. 12 is a bottom view of the multifunction backstop.
Figure 14:
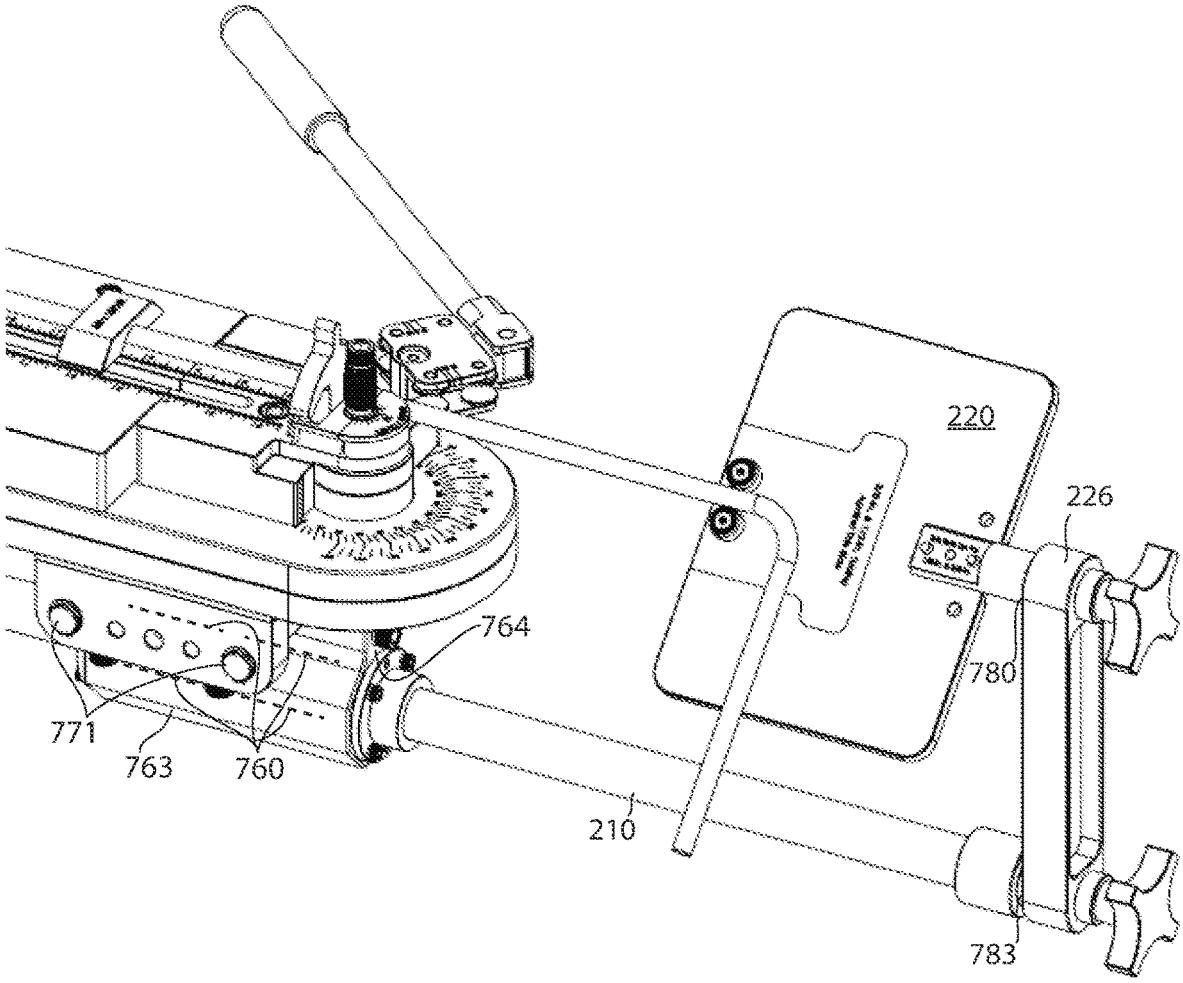
FIG. 14 is a perspective view of the bend plane angle plate side of the bender.
Figure 15:
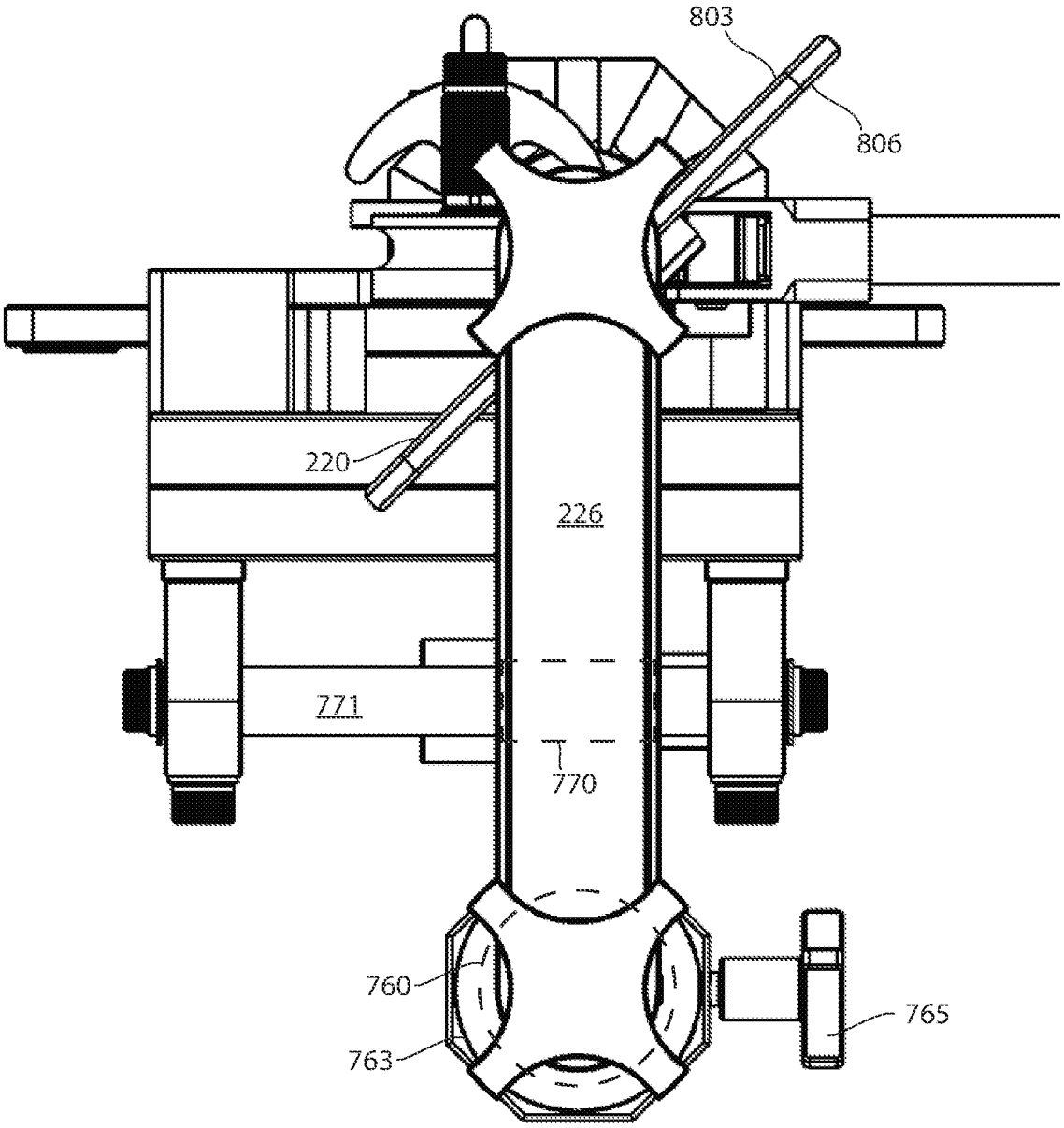
FIG. 15 is an elevation view of the bend plane angle plate side of the bender.
Figure 16:
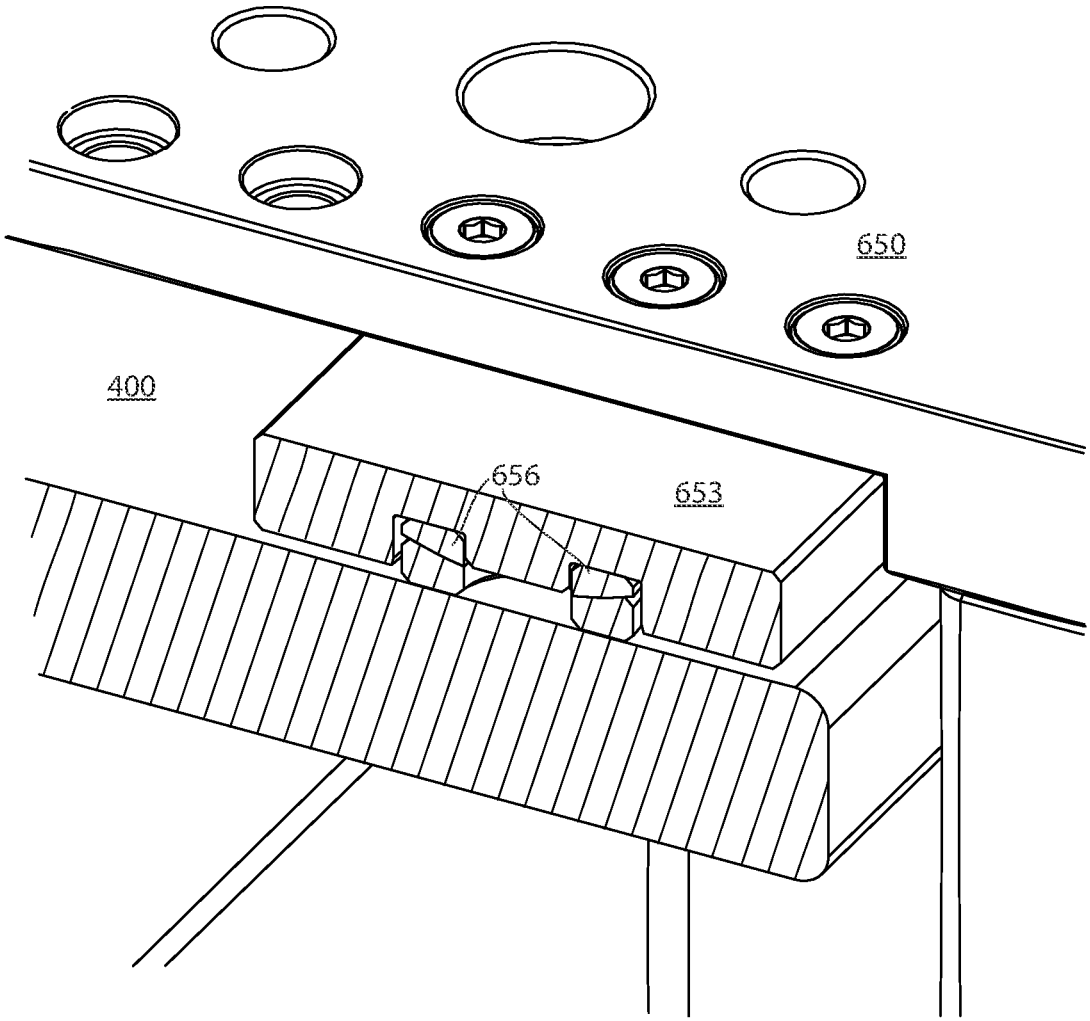
FIG. 16 is a cutaway view of the spherical washer supporting the mounting clips on the table.

The bender may be secured into the primary T-slot track by inserting the bender tongue into the bender tongue receiver and bolting the bender tongue within the bender tongue receiver as depicted in FIGS. 8, 9 and 14.

The bender tongue receiver may be fixed to the primary T-slot track providing a slot into which the bender tongue may fit. Either the bender tongue or the bender tongue receiver may have a beveled edge aiding in the initial manual insertion of the bender tongue into the bender tongue receiver without precision alignment. Then a bolt or other fastener may be used to secure the relationship between the bender with the primary T-slot track.

The mounting clips may be used to clamp the primary T-slot track to the table. C clamps or other similarly functioning clamps may be used for this purpose. Spherical washers may be used on the mounting clips to avoid alignment issues associated with clamping down the primary T-slot track to a table that may be slightly warped or bowed. Spherical washers may also be used in a similar way in embodiments that do not have mounting clips.

The linear scale on primary the T-slot track and the T-slot track extension pieces are configured to quickly assess the length of tubing from the beginning of the tube bend when the bender and tubing is set for bending. The tube marking aid may be used to mark tubing positioned in the bender.

Figure 13:
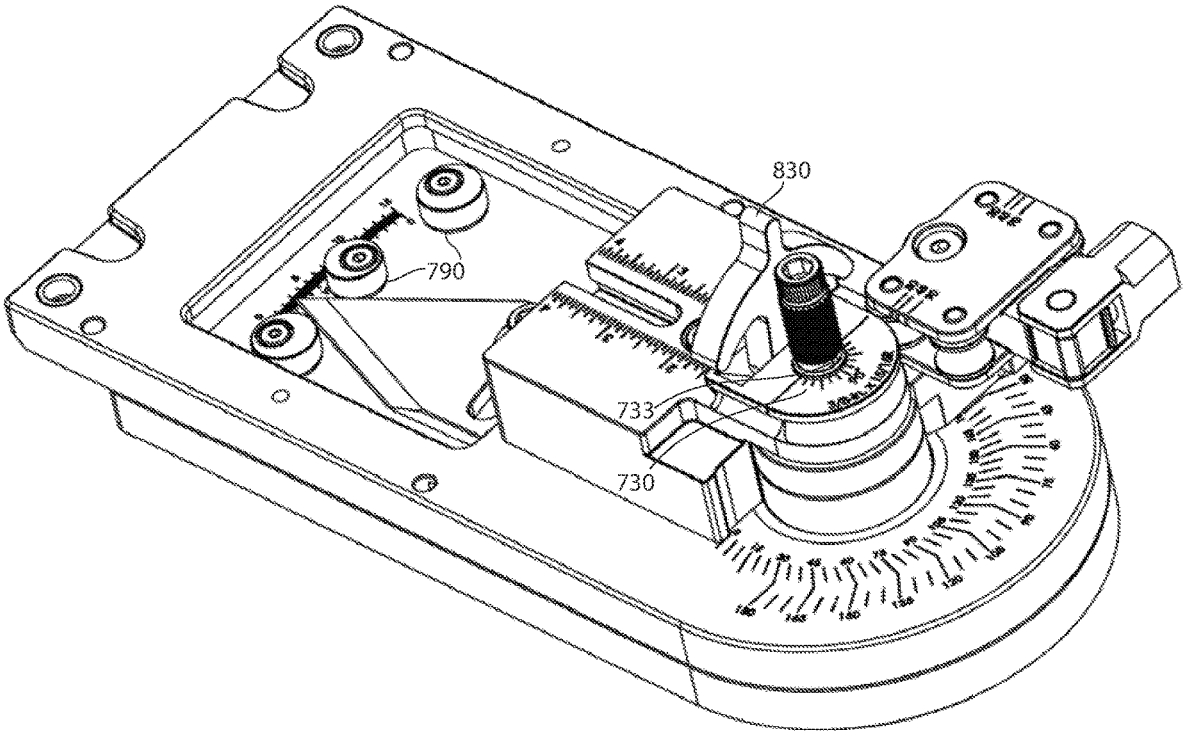
FIG. 13 is a partial close-up perspective view of the bender.

The Bend angle mechanical stop position indicator coupled with the Bend angle mechanical stop position scale may allow for a more intuitive setting of the position of the stop ring mechanical stop. To set the coarse adjustment of the bend angle, the Hirth joint lock bolt may be loosened until the annular post can freely rotate. As depicted in FIG. 13, the annular post may have a knurled grip and a marking such as a dot or a line serving as the bend angle mechanical stop position indicator. The annular post and the Bend angle mechanical stop position indicator may then be rotated to an angle marking shown on the Bend angle mechanical stop position scale thereby correctly positioning the stop ring mechanical stop. Then the Hirth joint lock bolt may be tightened thereby fixing the coarse adjustment of the bend angle. For example, the reading of the Bend angle mechanical stop position indicator on the Bend angle mechanical stop position scale may be the desired final bend angle or an angle near the desired final bend angle. Fine adjustments to the bend angle and the position of the stop ring mechanical stop are described above and may be used to account for springback and bending to angles in between those indicated on the Bend angle mechanical stop position scale. A less experienced user may choose to first set the bend angle fine adjustment arm to zero before setting the Hirth joint position indicator at or below the desired position on the Hirth joint position scale followed by again adjusting the bend angle fine adjustment arm. Doing so may be more intuitive until a user gains experience and comfort with the bender. After gaining experience with the tool, a user would likely view the position of the bend angle fine adjustment arm followed by fine and coarse adjustments in order of preference.

The position of the Bend angle mechanical stop position indicator relative to the Bend angle mechanical stop position scale provides a visual indication of the position of the stop ring mechanical stop. As described above, the various positions into which the bend angle Hirth joint can be joined and locked create a series of discrete stop positions for any given position of the bend angle fine adjustment arm. When the bend angle fine adjustment arm is locked relative to the bend angle fine adjustment scale, the coarse adjustments that occur by moving the bend angle Hirth joint into a different lockable positions correspond to an equivalent rotation of the stop ring mechanical stop. For example, with the bend angle fine adjustment arm locked in place, a one tooth rotation of the bend angle Hirth joint could result in the stop ring mechanical stop moving from a 45° stop position to a 60° stop position. In that case, the Bend angle mechanical stop position indicator would move along the Bend angle mechanical stop position scale from a visual indication of a 45° stop position to a visual indication of a 60° stop position. In the case where the bend angle fine adjustment arm is locked in a position indicating 2° of additional rotation on the bend angle fine adjustment scale, turning the bend angle Hirth joint one tooth rotation could result in the stop ring mechanical stop moving from a 47° stop position to a 62° stop position while at the same time causing the Bend angle mechanical stop position indicator to move along the Bend angle mechanical stop position scale from a visual indication of a 47° stop position to a visual indication of a 62° stop position. Accordingly, the position of the stop ring mechanical stop is consistently indicated by the position of the bend angle mechanical stop position indicator on the bend angle mechanical stop position scale.

Figure 5:
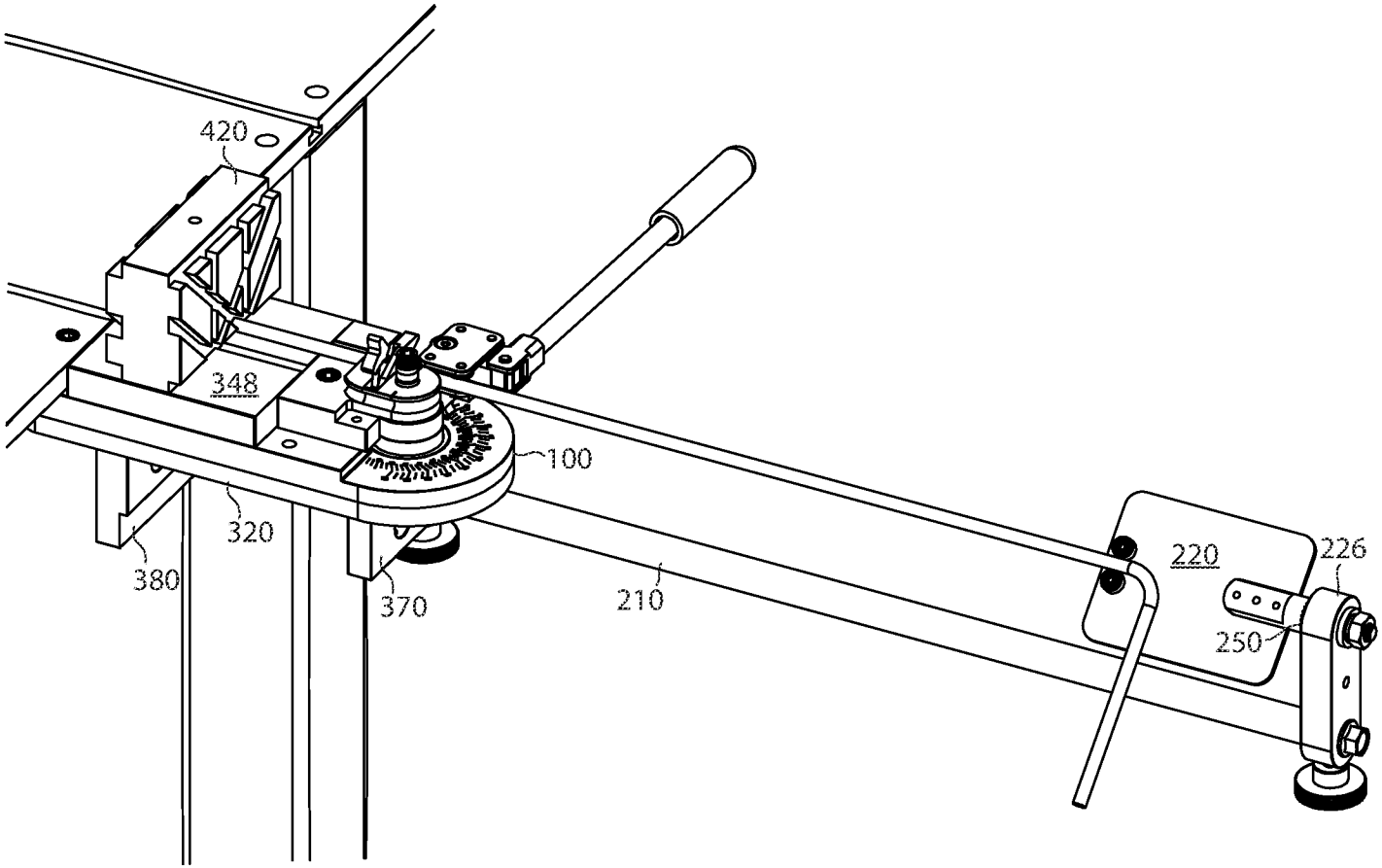
FIG. 5 is a perspective view of a bender mounted on a table.
Figure 6:
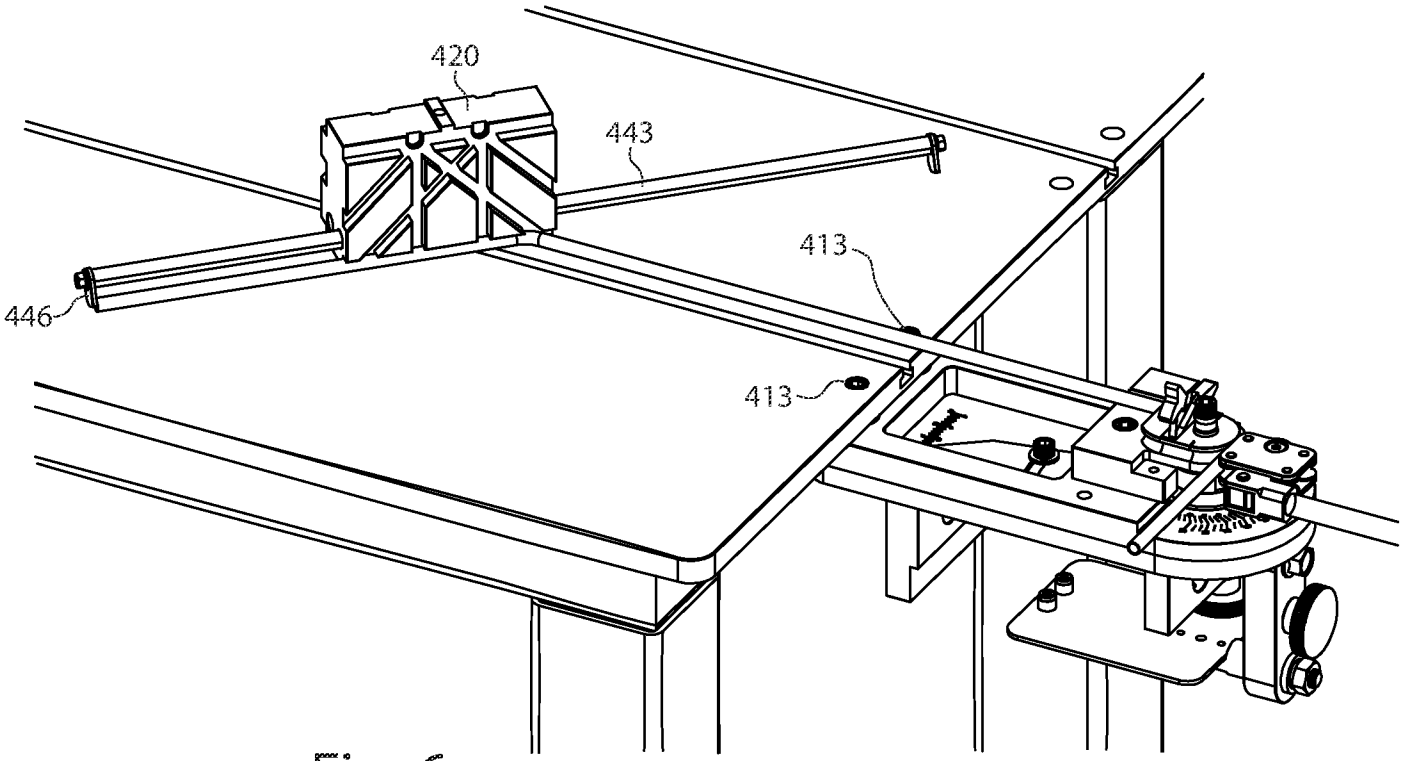
FIG. 6 is a perspective view of a bender mounted on a table.
Figure 7:
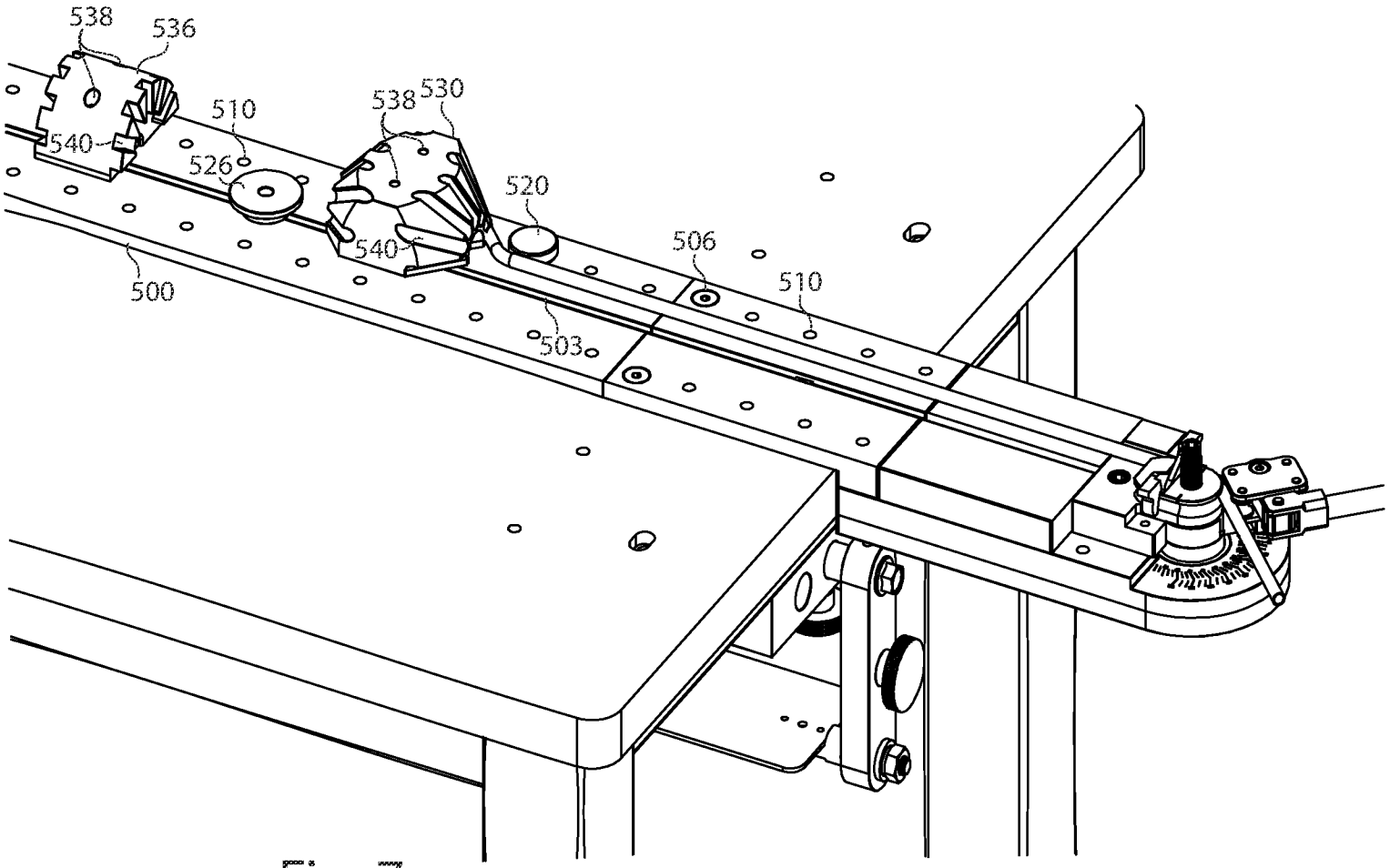
FIG. 7 is a perspective view of a bender mounted on a table.

Bend plane angle plate Hirth joint depicted in FIG. 14 is equivalent to the bend plane Hirth joint depicted in FIG. 5, however the embodiment of FIG. 14 also includes a bend plane angle plate deployment Hirth joint that allows Hirth joint type position locking in the operational position depicted, the storage position, and various positions in between. However, the fully upright and storage positions may be the only positions of practical significance.

The longitudinal linear bearings are in longitudinal linear bearing housing and support the extension shaft such that the bend plane angle plate may glide toward and away from the mandrel with little application of force then may be locked in place by longitudinal linear bearing locking and handle bolt, a set screw, or other similar mechanism.

The longitudinal linear bearing housing upper frame extends above the longitudinal linear bearings and hangs from the transverse linear bearing shafts. The longitudinal linear bearing housing may slide smoothly from side to side along the transverse linear bearing shafts by way of the transverse linear bearings. The motion of the longitudinal linear bearing housing along the transverse linear bearing shafts may be limited and secured on either side by mechanical stops and bolts that hold the bend angle plate either in a position to assist clockwise bending by bender or in a position to assist counterclockwise bending by the bender.

During operation of the bender when it becomes desirable to bend tubing around the mandrel in the opposite direction and the tubing is sufficiently long to benefit from the use of the bend angle plate, the extension shaft, bend plane plate support arm, and the bend angle plate may be moved from alignment with one side of the mandrel to alignment with the other side of the mandrel. When this is needed a securing bolt or pin may be removed, the longitudinal linear bearing housing including the longitudinal linear bearing housing upper frame may be pushed in the desired direction until they come to rest in alignment with the other side of the mandrel at which point the securing bolt or pin may be fastened on the other side of the bender to hold the longitudinal linear bearing housing in the new alignment position.

The longitudinal linear bearings and the transverse linear bearings may be ball bearing type linear bearings to allow for movement of the bend plane angle plate with little force.

The eccentrically adjustable fine bend angle mechanical stops may be used as adjustable mechanical stops to aid in the setting of two frequently used fine angle adjustment settings, for example the springback for a 90 degree and a 45 degree bend. For example, the fine angle lock bolt may be loosened, followed by the bend angle fine adjustment arm being moved from a position abutting one eccentrically adjustable fine bend angle mechanical stop to a position abutting another eccentrically adjustable fine bend angle mechanical stop, then the bend angle fine adjustment arm may be locked down again with the fine angle lock bolt. The eccentrically adjustable fine bend angle mechanical stops may be locked position; loosened, rotated, and tightened; or removed entirely through the operation of a securing bolt.

One or more T-slot track extension pieces may be installed to extend the functionality of the bender by making available the above-described tubing securing and measuring abilities at greater distances from the mandrel.

Each T-slot track extension piece may be secured to either the primary T-slot track for an adjacent T-slot track extension piece by way of a notched pin and a conical point set screw.

Figure 17:
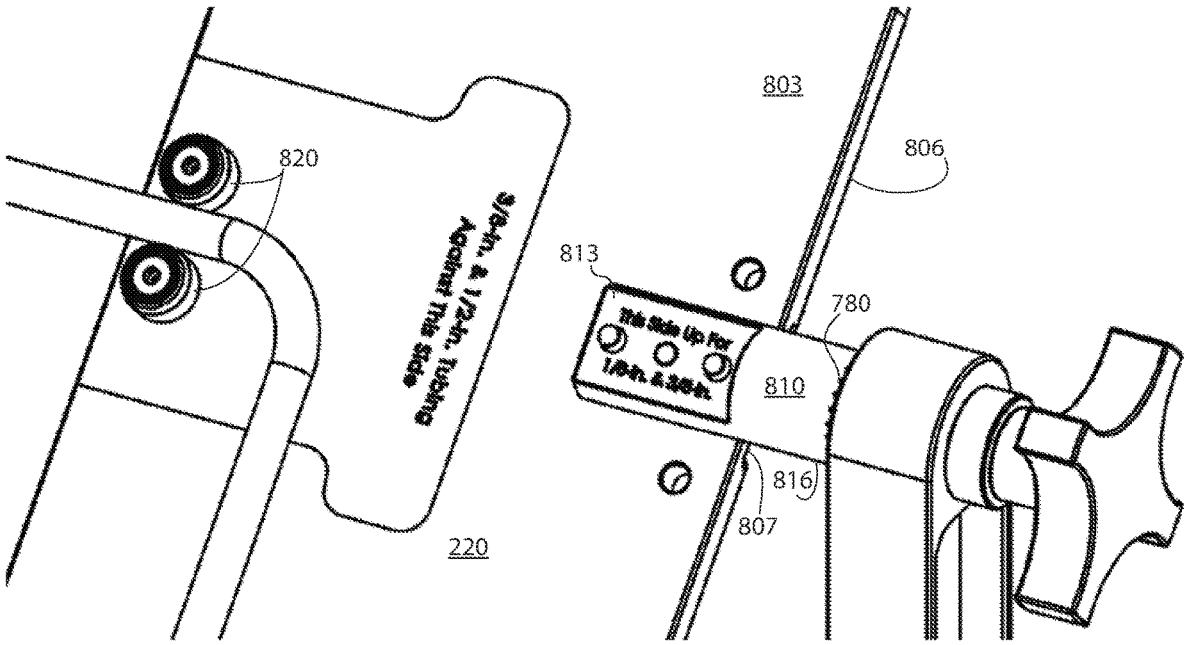
FIG. 17 is a partial close-up perspective view of the bend plane angle plate.

The bend plane angle plate may be configured for accurate alignment with the surface of multiple types of tubing. To accommodate that alignment, the central axis of the bend plane angle plate Hirth joint may be aligned with the central axis of the tubing as it sits ready for bending against the mandrel. The bend plane angle plate may be configured to be offset from the centerline of the tubing as that centerline is extended out from the tubing secured to the mandrel. The manner of combination of the bend plane angle plate with the bend plane angle plate mounting bracket may create multiple offsets. As depicted in FIG. 17 there may be four such offsets. When bend plane angle plate A-side and bend plane angle plate mounting bracket A-side both face the tubing, the configuration may accommodate a first size of tubing, which may for example be ⅜-inch tubing. In that example, the bend plane angle plate would be in contact with the ⅜-inch tubing to be bent regardless of the orientation of the bend angle plate Hirth joint except in cases in which a distal bend interferes with the relationship. When bend plane angle plate A-side and bend plane angle plate mounting bracket B-side both face the tubing, the configuration may accommodate a second size of tubing, which may for example be ½-inch tubing. When bend plane angle plate B-side and bend plane angle plate mounting bracket A-side both face the tubing, the configuration may accommodate a third size of tubing, which may for example be ⅛-inch tubing. When bend plane angle plate B-side and bend plane angle plate mounting bracket B-side both face the tubing, the configuration may accommodate a fourth size of tubing, which may for example be ¼-inch tubing. Bend plane angle plate B-side recess and the differences in the bend plane angle plate mounting bracket A-side mounting surface from the bend plane angle plate mounting bracket B-side mounting surface with respect to the axis of rotation of the bend plane angle plate Hirth joint account for the ability to accommodate four different sizes of tubing through various rotational positions of the bend plane angle plate Hirth joint. Reconfiguring the bend plane angle plate may be accomplished by removal of a single bolt, followed by switching to one of the other three assembly combinations, then reinstalling the bolt. The bend plane angle plate may be keyed or doweled to the bend plane angle plate mounting bracket such that a single bolt may be used for securing one to the other while still maintaining proper alignment.

The bend plane plate tubing support disks aid in supporting and positioning the tubing such that the central axis of the tubing and the central axis of the bend plane plate Hirth Joint are essentially coincident, especially when the extended portion of the tube has a high length to diameter ratio making the tubing more flexible or flimsy. The bend plane plate tubing support disks are useful when the bend plane angle plate is oriented vertically, and the center-of-gravity of the tubing is between the mandrel and the bend plane angle plate. The bend plane plate tubing support disks are also useful when the face of the bend plane angle plate is being used to position the tubing in the bender to achieve the correct start-of-bend location.

Most of the features described herein may be executed as a rotary draw bender. Similar mechanical stops, bend angle mechanical Hirth joint, bend angle fine adjustment arm, backstops, and other components would be executed in a similar way with application of those changes necessary to alter the manner of bending to match the form of a rotary draw bender.

Benders described herein may, for example comprise a mandrel configured to bend tubing having an outer diameter that is less than 0.7 inches; an axis of symmetry of the mandrel; a first adjustable mechanical stop arranged and configured to limit the bending of tubing around the mandrel in a first direction; a securing mechanism arranged and configured to releasably fix the first adjustable mechanical stop in a position relative to the mandrel; a tubing contact component arranged and configured to rotate around the mandrel; a lever arranged and configured for manual operation of the tubing contact component; and a scale arranged and configured to correspond to a tubing bend angle; such that the scale is located at least 1.2 bend radii from the axis of symmetry of the mandrel. In a related example, the bender may have a multiple bend plane angle support arranged and configured to lock in place at various distances from the mandrel. In a related example, the bender may have a scale that has at least one marking for every 5° on the scale. In a related example, the scale may have at least one marking for every 1° on the scale. In a related example, the bender may have a multiple bend plane angle support lockable at multiple distances from the mandrel. In a related example, the bender may have a second adjustable mechanical stop arranged and configured to limit the bending of tubing around the mandrel in a second direction.

Benders described herein may, for example comprise a mandrel configured to bend tubing having an outer diameter that is less than 0.7 inches; an axis of symmetry of the mandrel; an adjustable mechanical stop arranged and configured to limit the bending of tubing around the mandrel; a first securing mechanism arranged and configured to releasably fix the adjustable mechanical stop in a position relative to the mandrel; a tubing contact component arranged and configured to rotate around the mandrel; an indicator corresponding to a position of the mechanical stop; and a scale arranged and configured to correspond to a bend angle; such that the indicator is adjacent to the scale and a position of the indicator relative to the scale corresponds to a position of the adjustable mechanical stop; and the scale is located at least 3.0 bend radii from the axis of symmetry of the mandrel. In a related example, the first securing mechanism may include a Hirth joint. In a related example, the bender may have a second securing mechanism arranged and configured to releasably fix the adjustable mechanical stop in a position relative to the mandrel. In a related example, the bender may have a multiple bend plane angle support arranged and configured to lock in place at various distances from the mandrel. In a related example, the scale may have at least one marking for every 5° on the scale. In a related example, the scale may have at least one marking for every 1° on the scale. In a related example, the bender may have a multiple bend plane angle support lockable at multiple distances from the mandrel. In a related example, the bender may have a rotating bend plane angle support lockable at multiple distances from the mandrel.

Benders described herein may, for example comprise a mandrel configured to bend tubing having an outer diameter that is less than 0.7 inches; an axis of symmetry of the mandrel; a tubing contact component arranged and configured to rotate around the mandrel; a coarse adjustment scale; a coarse adjustment indicator; a fine adjustment scale; a fine adjustment indicator; an incremental angle lock; such that the incremental angle lock sets a relationship between the coarse adjustment scale and the fine adjustment scale; a tubing bend angle may be determined by reference to the coarse adjustment scale, the coarse adjustment indicator, the fine adjustment scale, and the fine adjustment indicator; and the fine adjustment scale is located at least 2.5 bend radii from the axis of symmetry of the mandrel. In a related example, the bender may have a multiple bend plane angle support arranged and configured to lock in place at various distances from the mandrel. In a related example, the coarse adjustment scale may have at least one marking for every 30° on the coarse adjustment scale. In a related example, the fine adjustment scale may have at least one marking for every 1° on the fine adjustment scale. In a related example, the bender may have a multiple bend plane angle support lockable at multiple distances from the mandrel. In a related example, the bender may have a rotating bend plane angle support lockable at multiple distances from the mandrel.

Benders described herein may, for example comprise a mandrel configured to bend tubing having an outer diameter that is less than 0.7 inches; a first adjustable mechanical stop arranged and configured to limit the bending of tubing around the mandrel in a first direction; a tubing contact component arranged and configured to rotate around the mandrel; a lever arranged and configured for manual operation of the tubing contact component; a multiple bend plane angle support arranged and configured to lock in place at various distances from the mandrel; and a first linear bearing such that the multiple bend plane angle support moves relative to the mandrel and such that the first linear bearing is arranged and configured to support the motion of the multiple bend plane angle support relative to the mandrel. In a related example, the bender may further include a second linear bearing such that the second linear bearing is arranged and configured to support the motion of the multiple bend plane angle support relative to the mandrel and such that the motion supported by the first linear bearing is along a different axis than the motion supported by the second linear bearing.

Benders described herein may, for example comprise a mandrel configured to bend tubing having an outer diameter that is less than 0.7 inches; a first adjustable mechanical stop arranged and configured to limit the bending of tubing around the mandrel in a first direction; a tubing contact component arranged and configured to rotate around the mandrel; a lever arranged and configured for manual operation of the tubing contact component; a linear scale indicating distance markings that increase in value as distance from the mandrel increases; a backstop comprising a group of slots; a first slot from the group of slots arranged and configured to secure tubing having a bend plane angle with an absolute value of 45°; and a second slot from the group of slots arranged and configured to secure tubing having a bend plane angle with an absolute value of 90° such that the backstop is arranged and configured to be secured at multiple points along the linear scale. In a related example, the bender may also include a linear scale arranged and configured to measure along the stationary side of tubing. In a related example, the bender may also include a marking aid arranged and configured to partially surround tubing and further arranged and configured to slide along the linear scale. In a related example, the bender may also include a backstop configured to hold at least four different distal bend angles. In a related example, the backstop has slots arranged and configured to hold tubing and prevent the rolling of a distal bend. In a related example, the backstop is lockable into a T-slot track. In a related example, the first slot is arranged and configured to support bend angles of both 45° and 90° and the second slot is arranged and configured to support bend angles of both 45° and 90°. In a related example, the bender has mounting clips such that the mounting clips are arranged and configured for clamping the bender to a table. In a related example, the bender has spherical washers located on an underside of the bender wherein the spherical washers are arranged and configured as load bearing contact points with the table. In a related example, a first portion of the bender is configured for attachment to a table and a second portion of the bender including the mandrel is arranged and configured for intermittent removal from the table without removing the first portion of the bender.

Benders described herein may, for example comprise a mandrel configured to bend tubing having an outer diameter that is less than 0.7 inches; an adjustable bend angle mechanical stop arranged and configured to limit the bending of tubing around the mandrel in a first direction; a tubing contact component arranged and configured to rotate around the mandrel; a lever arranged and configured for manual operation of the tubing contact component; and an incremental bend angle lock; such that the incremental bend angle lock has a first incremental bend angle lock locked position limiting the adjustable bend angle mechanical stop to a first range of mechanical stop positions that includes a mechanical stop position at a 90° bend angle; and further including a fine adjustment component arranged and configured to adjust the position of the adjustable bend angle mechanical stop by at least 2° when the incremental bend angle lock is locked in the first incremental bend angle lock locked position. In a related example, the bender also includes a multiple bend plane angle support arranged and configured to lock in place at various distances from the mandrel. In a related example, the multiple bend plane angle support is a bend plane angle plate. In a related example, the multiple bend plane angle support is a backstop. In a related example, the incremental bend angle lock is a Hirth joint. In a related example, the bender also includes a position indicator representing the position of the adjustable bend angle mechanical stop. In a related example, the bender also includes a coarse adjustment indicator connected to the incremental bend angle lock. In a related example, the bender also includes a coarse adjustment angle indication and a fine adjustment angle indication wherein the coarse adjustment angle indication indicates the position of the adjustable bend angle mechanical stop through the first range of mechanical stop positions.

The above-described embodiments have a number of independently useful individual features that have particular utility when used in combination with one another including combinations of features from embodiments described separately. There are, of course, other alternate embodiments which are obvious from the foregoing descriptions, which are intended to be included within the scope of the present application.

The invention claimed is:

1. A bender comprising:

a. a mandrel configured to bend tubing having an outer diameter that is less than 0.7 inches;

b. a first adjustable mechanical stop arranged and configured to limit the bending of tubing around the mandrel in a first direction;

c. a tubing contact component arranged and configured to rotate around the mandrel;

d. a lever arranged and configured for manual operation of the tubing contact component;

e. a multiple bend plane angle support arranged and configured to lock in place at various distances from the mandrel; and f. a first linear bearing;

g. wherein the multiple bend plane angle support moves relative to the mandrel; and h. wherein the first linear bearing is arranged and configured to support the motion of the multiple bend plane angle support relative to the mandrel.

2. The bender of claim 1 further comprising a second linear bearing wherein the second linear bearing is arranged and configured to support the motion of the multiple bend plane angle support relative to the mandrel and wherein the motion supported by the first linear bearing is along a different axis than the motion supported by the second linear bearing.

3. A bender comprising:

a. a mandrel configured to bend tubing having an outer diameter that is less than 0.7 inches;

b. a first adjustable mechanical stop arranged and configured to limit the bending of tubing around the mandrel in a first direction;

c. a tubing contact component arranged and configured to rotate around the mandrel;

d. a lever arranged and configured for manual operation of the tubing contact component;

e. a linear scale indicating distance markings that increase in value as distance from the mandrel increases;

f. a backstop comprising a group of slots;

g. a first slot from the group of slots arranged and configured to secure tubing having a bend plane angle with an absolute value of 45°; and h. a second slot from the group of slots arranged and configured to secure tubing having a bend plane angle with an absolute value of 90°;

i. wherein the backstop is arranged and configured to be secured at multiple points along the linear scale.

4. The bender of claim 3 further comprising a linear scale arranged and configured to measure along the stationary side of tubing.

5. The bender of claim 4 further comprising a marking aid arranged and configured to partially surround tubing and further arranged and configured to slide along the linear scale.

6. The bender of claim 3 further comprising a backstop configured to hold at least four different distal bend angles.

7. The bender of claim 3 wherein the backstop comprises slots arranged and configured to hold tubing and prevent the rolling of a distal bend.

8. The bender of claim 3 wherein the backstop is lockable into a T-slot track.

9. The bender of claim 3 wherein first slot is arranged and configured to support bend angles of both 45° and 90° and wherein the second slot is arranged and configured to support bend angles of both 45° and 90°.

10. The bender of claim 3 further comprising mounting clips wherein the mounting clips are arranged and configured for clamping the bender to a table.

11. The bender of claim 3 further comprising spherical washers located on an underside of the bender wherein the spherical washers are arranged and configured as load bearing contact points with the table.

12. The bender of claim 3 wherein a first portion of the bender is configured for attachment to a table and a second portion of the bender including the mandrel is arranged and configured for intermittent removal from the table without removing the first portion of the bender.

13. A bender comprising:

a. a mandrel configured to bend tubing having an outer diameter that is less than 0.7 inches;

b. an adjustable bend angle mechanical stop arranged and configured to limit the bending of tubing around the mandrel in a first direction;

c. a tubing contact component arranged and configured to rotate around the mandrel;

d. a lever arranged and configured for manual operation of the tubing contact component; and e. an incremental bend angle lock;

f. wherein the incremental bend angle lock has a first incremental bend angle lock locked position limiting the adjustable bend angle mechanical stop to a first range of mechanical stop positions that includes a mechanical stop position at a 90° bend angle; and g. further comprising a fine adjustment component arranged and configured to adjust the position of the adjustable bend angle mechanical stop by at least 2° when the incremental bend angle lock is locked in the first incremental bend angle lock locked position.

14. The bender of claim 13 further comprising a multiple bend plane angle support arranged and configured to lock in place at various distances from the mandrel.

15. The bender of claim 14 wherein the multiple bend plane angle support is a bend plane angle plate.

16. The bender of claim 14 wherein the multiple bend plane angle support is a backstop.

17. The bender of claim 13 wherein the incremental bend angle lock is a Hirth joint.

18. The bender of claim 13 further comprising a position indicator representing the position of the adjustable bend angle mechanical stop.

19. The bender of claim 13 further comprising a coarse adjustment indicator connected to the incremental bend angle lock.

20. The bender of claim 13 further comprising a coarse adjustment angle indication and a fine adjustment angle indication wherein the coarse adjustment angle indication indicates the position of the adjustable bend angle mechanical stop through the first range of mechanical stop positions.

* * * * *